United States Patent [19]

Berneburg et al.

[11] Patent Number: 4,768,586

[45] Date of Patent: Sep. 6, 1988

[54] CERAMIC HEAT EXCHANGERS

[75] Inventors: Philip L. Berneburg, Lynchburg, Va.; Jamal N. Duqum, Mantua; Kathryn W. Grant, Stow, both of Ohio; Daniel R. Petrak, Lynchburg, Va.

[73] Assignee: The Babcock & Wilcox Company, New Orleans, La.

[21] Appl. No.: 32,913

[22] Filed: Apr. 1, 1987

Related U.S. Application Data

[63] Continuation of Ser. No. 665,908, Oct. 29, 1984, abandoned.

[51] Int. Cl.[4] ..... F28D 1/04

[52] U.S. Cl. ..... 165/163; 165/905; 165/176

[58] Field of Search ..... 165/158, 163, 177, 905, 165/176

[56] References Cited

U.S. PATENT DOCUMENTS

| | | | |
|---|---|---|---|
| 3,112,793 | 12/1963 | Sass | 165/177 X |
| 3,572,999 | 3/1971 | Sato | 165/177 X |
| 4,090,557 | 5/1978 | Currier | 165/163 X |
| 4,222,434 | 9/1980 | Clyde | 165/185 X |
| 4,286,551 | 9/1981 | Blitz | 165/163 X |
| 4,360,057 | 11/1982 | Koump | 165/158 X |
| 4,450,904 | 5/1984 | Volz | 165/163 X |
| 4,545,429 | 10/1985 | Place, Jr. et al. | 126/442 |
| 4,582,126 | 4/1986 | Corey | 165/905 |

*Primary Examiner*—Ira S. Lazarus
*Assistant Examiner*—Peggy Neils
*Attorney, Agent, or Firm*—Robert J. Edwards

[57] ABSTRACT

A ceramic fiber-reinforced ceramic heat exchanger includes a tube sheet and one or more coiled, oval cross-section U-tubes formed integrally with the tube sheet, wherein both the tube and tube sheet are composed of a ceramic fiber-reinforced ceramic composition, particularly suited for waste heat recovery in harsh flue gas environments.

18 Claims, 1 Drawing Sheet

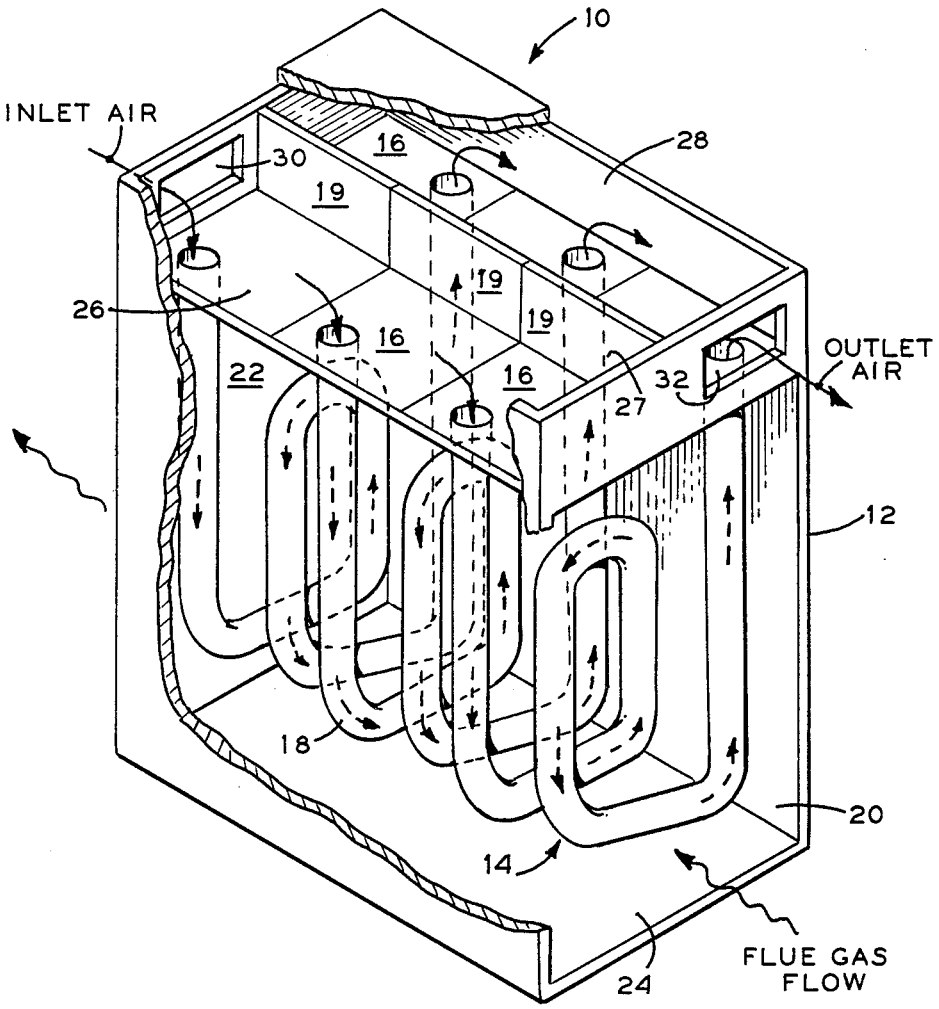
10
INLET AIR
30
16
28
19
19
26
19
16
22
16
27
32
OUTLET AIR
12
18
20
14
24
FLUE GAS FLOW

CERAMIC HEAT EXCHANGERS

This application is a continuation of application Ser. No. 665,908, filed Oct. 29, 1984 now abandoned.

BACKGROUND OF THE INVENTION

This invention relates to heat exchangers for harsh environments and in particular to modular heat exchange tubes and tube sheets of a novel and advantageous composition and construction.

High temperature industrial furnaces often operate very inefficiently due to exhaust gas thermal losses. In the aluminum industry, for example, stack losses for some furnaces are estimated to be as high as seventy-five percent. Major waste heat losses are associated with exhaust gases of aluminum remelt furnaces and, as well, in glass melting and steel soaking and reheat operations. The exhaust gases in such applications have temperatures in the range of 1500° to 3000° F. Moreover, the high-temperature gases contain surface-fouling particulates and highly corrosive contaminants which may readily degrade exhaust flue construction materials. The particulates tend to clog and foul the surfaces of heat exchangers inserted in the flue for heat recovery purposes.

Thus, efficient recovery of waste heat from high-temperature (greater than 1500° F.) industrial, dirty waste gas streams of glass melting furnaces, aluminum remelt furnaces and steel soaking and reheat furnaces represent a high-priority objective.

In the past, metallic exchangers have been used to recover waste heat. Metals cannot, however, usually retain required strengths at material temperatures that exceed 1500° F. Although the addition of exotic alloying agents may extend the retention of strength to about 1900° F. in the environment of a relatively clean flue gas stream, hot corrosive contaminants will reduce the durability of such metals. Thus, conventional metallic heat exchangers cannot survive for extended periods in these high-temperature, highly corrosive environments unless a significant dilution of the gas stream to a lower flue gas temperature is effected which, in any event, reduces the efficiency of the heat recovery process.

Ceramic materials offer the potential of allowing significantly higher material temperatures while resisting attack by many of the corrosive and surface-fouling contaminants that are present in industrial waste gas streams. Previous attempts to recover waste heat with ceramic heat exchangers have met with limited success. The major problems have been leakage through joints, such as tube-to-tube sheet joints, and thermally-induced cracks. In addition, many of the ceramic-based heat exchanger designs have narrow flow passages which are prone to clogging in fouling environments resulting in high pressure drops, especially on the hot flue gas side. Other difficulties encountered in making ceramic heat exchangers include problems in making complex shapes, including thin-walled sections while simultaneously achieving high resistance to corrosion and tube cracking caused by thermal shock.

Accordingly, a need has been recognized for advanced heat recovery heat exchangers having durable construction materials that are compatible with the waste stream constituents, in temperature ranges of 1500° F. to 3000° F., that resist fouling and are easily cleaned, and which provide commercially viable heat exchange rates and effectiveness while being physically sized to allow retrofitting in existing facilities.

SUMMARY OF THE INVENTION

The invention is directed to the construction or formation of improved heat exchange elements from compositions comprising woven or braided ceramic fibers with a dense ceramic matrix that will provide highly effective physical and thermal properties for direct heat recovery from the waste gas streams of aluminum remelt furnaces, glass melting furnaces, and steel soaking and reheat furnaces.

In accordance with the invention, there is provided a heat exchanger comprised of a coiled, tubular element and a tube sheet which are integrally formed into a unit from ceramic fibers by weaving, braiding or other processes. The structure is reinforced by impregnating the fibers with a ceramic material such as silicon carbide or alumina.

According to a preferred embodiment of the invention, the tubes comprise a helical U-tube. The tube has an oval cross-section. The fibers of the tube are integrally braided or woven to the fibers of the tube sheet and the tube is joined to and vertically suspended, at each end of the tube, from the tube sheet. The tube has an open first end and an open second end within the tube sheet. The tube extends from the first end through a substantially coiled path to the second end. In another embodiment, an integral baffle is formed as part of the tube sheet between the openings of the first end and second end and separates the openings. A fluid flowing on one side of the baffle enters the open first end, passes within the tube through the tube sheet, thence through the coiled portion of the tube on the opposite side of the tube sheet, and exits through the open second end of the tube.

A particular embodiment of the heat exhanger is specifically designed for waste heat recovery in horizontal high temperature furnace flues. In such arrangements, an elongated hollow duct is provided in the form of an outer shell or housing. The tube sheet is mounted within the duct's cavity and divides the cavity into a lower gas chamber and upper air chamber. The tube is suspended into the lower flue gas chamber and means are provided for directing a flow of flue gas across the outside surface of the tube, in parallel with the major axis of the tube's oval cross-section, preferably in counterflow heat exchange relationship. The integral baffle, in cooperation with the walls of the duct, divides the upper chamber into two plenums. Means are provided for passing a heat recovery fluid, such as air, into one plenum and the open first end of the tube, through the tube, and out of the second plenum. The coiled arrangement of the tube provides a multi-pass heat exchange effect.

BRIEF DESCRIPTION OF THE DRAWING

The sole FIGURE is a perspective view, partly broken away, illustrating a heat exchanger having a plurality of heat exchange elements constructed in accordance with a preferred embodiment of the invention.

DETAILED DESCRIPTION

The present invention is generally directed to a heat exchange element using ceramic fiber-reinforced ceramics woven into an integral combination comprising a tube sheet and a coiled tube.

The tube and tube sheet are made from ceramic fiber-reinforced ceramics using a multi-dimensional weaving or braiding technique, such as is disclosed in U.S. Pat. No. 4,312,261, to provide suitable preforms. A number of ceramic fibers have been successfully woven into preforms including Nicalon (silicon carbide) fibers from Nippon-Carbon, Dupont FP (alumina) and Nextel (aluminaborosilicate glass fiber) from 3M. The tube and tube sheet preforms may be made separately by the same or different fiber forming processes and then joined to each other by braiding, weaving, sewing or splicing techniques. The final subcomponent preforms are combined with a matrix by techniques such as chemical vapor infiltration or impregnation via ceramic precursor solutions or colloidal suspensions to form a dense ceramic matrix composite. The elements are modular in structure with the tubes, tube sheets and, in certain embodiments, a tube sheet baffle being formed as a single piece. The techniques of manufacturing a ceramic fiber preform and then creating a ceramic matrix around the fibers provides the ability to form complex structures, such as spiraled U-tubes, coiled and helical shapes, by simple weaving processes. Other ceramic fiber processing techniques can be utilized for simpler structures, for example, vacuum forming techniques can be employed to obtain structures embodying discontinuous fibers.

Based on exposure test results, it was determined that suitable material composition for the practice of this invention would have a comprise ceramic fibers within ceramic matrices possessing effective resistance and integrity when subjected to the corrosive exhaust flue environment of an aluminum melting furnace for sixty (60) days at 2300° F. average flue temperature in the presence of chlorides and fluorides.

Suitable ceramic composites include ceramic fibers such as silicon carbide, alumina, mullite, aluminaborosilicate glass, or zirconia fibers which are liquid impregnated by chemical solutions or colloidal suspensions which serve as precursors for suitable oxide matrices such as mullite, alumina, zirconia or chromic oxide. An alumina sol has been found to be a suitable precursor for an alumina matrix, and a silica-aluminum acetate solution or colloidal suspension can be used as a precursor for a mullite matrix. Another acceptable approach includes the addition of the matrix to the fabricated preform by chemical vapor infiltration techniques which comprise the in-depth deposition of ceramic materials, such as silicon carbide, into porous preforms by vapor phase transport of chemical species and thermally activated reaction and deposition. In such a process, the components which are to be coated are preferably heated in a vacuum furnace while gaseous reactants are caused to flow through the furnace. The temperature, pressure, gas composition and flow rates are controlled to achieve in-depth infiltration.

The FIGURE shows a heat exchanger 10. The heat exchanger 10 comprises a horizontally elongated hollow duct 12 of rectangular cross-section which houses one or more heat exchange elements 14. Each heat exchange element 14 includes at least one tube sheet 16 and a tube 18 integrally formed with the tube sheet as described hereafter. Each tube sheet 16 includes an open first end and an open second end of the tube 18 on opposite sides of a central baffle 19. The tube 18 and central baffle 19 are formed integrally with the tube sheet 16. The tube 18 extends between the first end and second end through a coiled path. The duct 12 includes a hollow cavity which is divided by the tube sheet 16 into a lower flue gas chamber 24 and an upper air chamber 27. The duct 12 is open ended below the tube sheet with openings 20, 22 in communication with the lower flue gas chamber 24. The baffle 19 extends above the tube sheet within the air chamber 27 and divides the air chamber 27 into an air inlet plenum 26 and an air outlet plenum 28.

Preferably, a plurality of the heat exchange elements 14 are arranged successively and continuously between the flue gas inlet end 20 and outlet end 22 of the housing 12 such that the tube sheets 16 transversely separate the housing into the lower chamber 24 and the upper chamber. The upper chamber 27 being further divided, by the successive and continuous arrangement of the baffles 19, into the air inlet plenum 26 and air outlet plenum 28.

Thus, in the embodiment of FIG. 1, a multiplicity of U-shaped coiled tubes 18, are disposed in the lower chamber 24 of the housing 12 which forms a flue gas passage from the inlet 20 through the outlet 22 and is bounded by the bottom of the housing 12, part of the sides of the housing 12 and the tube sheets 16. The tube ends of the U-shaped, coiled tubes 18 are received in the tube receiving openings of the tube sheet 16 and are suspended from the tube sheet 16. The dividing baffle 19 is fixed to the upper face of the tube sheet 16 and in conjunction with the upper wall of the housing 12, a portion of the side walls and the tube sheet 16 forms the air inlet and outlet plenums 26 and 28, respectively.

Inlet and outlet openings 30 and 32, respectively, provide the means for the passage of air, or other fluid which is to be heated, into the inlet plenum 26, thence the tubes 18 and through the tube sheets 16 of the heat exchange elements 14 and through the outlet plenum 28.

The preferred tubes 18 are oval in their cross-section. The major axis of the oval cross-section is oriented parallel to the flue gas flow.

Use of an oval tube cross-section, with the major axis oriented parallel to the flue gas flow, provides increased circumferential heat transfer area over circular cross-section tubes. In addition, fouling is reduced due to the fact that a small direct impingement area is exposed to the on coming particulate and gaseous contaminants. This arrangement also tends to lessen flue-side pressure drop. The integral formation of the tube and tube sheet virtually eliminates the undesirable tube-to-tube sheet joint leakage that can occur in conventional material designs.

The illustrated arrangement is particularly adapted to use in connection with the horizontal flues and may be readily retrofitted to such constructions.

In operation, the heat exchange elements 14 will be vertically suspended in the flue such that flue gases will pass over the outer surface of the coiled U-tubes 18. On the air side of the heat exchanger 10, inlet air enters the inlet plenum 26 formed by the walls, tube sheets 16 and baffles 19 of the heat exchange element 14, flows down into one leg of the heat exchange tube 18, spirals around, then discharges through the opposite leg of the tube 18 into the exit plenum 28. The illustrated heat exchanger is a gas-to-gas, cross-counterflow heat exchanger.

It will be evident to those skilled in the art that the relative location of the tube can be changed and that multiple tubes in single or plural tube sheets could be advantageously utilized taking into consideration heat transfer surface area and heat transfer rates, space availability, and the composition and flow rate of the waste stream from which heat recovery is desired. Where plural tubes are used, for example, it may be desirable to alternately stagger the tubes on opposite sides of the central flow line of the flue gas.

The embodiments of the invention in which an exclusive property or privilege is claimed are defined as follows:

1. A heat exchanger for waste heat recovery in high temperature furnace flues comprising a single piece heat exchange element defining two portions characterized as a tube sheet and a tube, the tube having a first tube leg with an open first end and a second tube leg with an open second end, both ends being formed integrally with the tube sheet, the first tube leg and the second tube leg being substantially perpendicular to the tube sheet, said tube including a coiled tube portion interconnected to the first tube leg and the second tube leg, said tube portion extending from the first tube leg through a spiraled path turning around an axis substantially parallel to the tube sheet to the second tube leg, and wherein said tube sheet and said tube comprise a ceramic fiber-reinforced ceramic composite of a ceramic fiber integrally bound and arranged within a ceramic matrix, the ceramic fibers of the tube sheet and the tube being continuous fibers.

2. A heat exchanger according to claim 1 wherein the ceramic fibers of the tube and tube sheet are integrally woven to each other.

3. A heat exchanger according to claim 1 wherein the ceramic fibers of the tube and tube sheet are integrally braided to each other.

4. A heat exchanger as recited in claim 1 wherein the ceramic matrix comprises silicon carbide.

5. A heat exchanger is recited in claim 1 wherein the ceramic matrix comprises alumina.

6. A heat exchanger as recited in claim 1 wherein the ceramic matrix comprises mullite.

7. A heat exchanger as recited in claim 1 wherein the ceramic matrix comprises chromic oxide.

8. A heat exchanger as recited in claim 1 wherein the ceramic matrix comprises zirconia.

9. A heat exchanger as recited in claim 1 wherein the ceramic fibers comprise silicon carbide.

10. A heat exchanger as recited in claim 1 wherein the ceramic fibers comprise alumina.

11. A heat exchanger as recited in claim 1 wherein the ceramic fibers comprise mullite.

12. A heat exchanger as recited in claim 1 wherein the ceramic fibers comprise alumina-borosilicate glass.

13. A heat exchanger as recited in claim 1 wherein the ceramic fibers comprise zirconia.

14. A heat exchanger as recited in claim 1 wherein the tube has an oval cross-section.

15. A heat exchanger as recited in claim 14 further comprising an elongated hollow duct including a hollow cavity; the tube sheet being mounted within the cavity and separating the cavity into a flue gas chamber and an air chamber, the tube extending within the flue gas chamber, and said tube sheet including an integral baffle intermediate the first end and second end of the tube,and secured to said duct to divide said air chamber into an air inlet plenum and an air outlet plenum; said duct having end openings defining a flue gas inlet and a flue gas outlet in communication with the flue gas chamber and a plurality of openings in communication with the air chamber to define an air inlet opening communicating with the air inlet plenum and an outlet air opening in communication with the air outlet plenum.

16. A heat exchanger as recited in claim 15 wherein the major axis of the oval tube cross-section is oriented substantially parallel with the path of flue gas flowing from the flue gas inlet opening to the flue gas outlet opening.

17. A heat exchanger as recited in claim 16 wherein the duct is horizontally elongated and the tube is suspended within the lower chamber from the tube sheet.

18. A heat exchanger as recited in claim 16 wherein a plurality of tubes are successively mounted to the tube sheet between the flue gas inlet and the flue gas outlet.

* * * * *